United States Patent [19]

Gonzales

[11] Patent Number: 4,975,688

[45] Date of Patent: Dec. 4, 1990

[54] PARTICULATE DETECTOR DISABLING AND PROTECTING SYSTEM

[76] Inventor: Ronald A. Gonzales, 13409 Glenside, Farmers Branch, Tex. 75234

[21] Appl. No.: 484,921

[22] Filed: Feb. 26, 1990

Related U.S. Application Data

[62] Division of Ser. No. 247,522, Sep. 22, 1988.

[51] Int. Cl.[5] ..... B65D 65/02; B65D 85/00

[52] U.S. Cl. ..... 340/693; 150/165; 383/71; 383/72; 383/127; 340/628

[58] Field of Search ..... 340/693, 628, 629, 630; 383/71, 72, 127, 902; 150/165, 154; 116/201, 200

[56] References Cited

U.S. PATENT DOCUMENTS

| | | | |
|---|---|---|---|
| 1,164,450 | 12/1915 | Bates | 383/71 |
| 1,633,988 | 6/1927 | Jones | 16/D162 |
| 3,722,470 | 3/1973 | Farrell | 118/505 |
| 4,008,851 | 2/1977 | Hirsch | 383/71 |
| 4,679,037 | 7/1987 | Bryan et al. | 340/693 |

FOREIGN PATENT DOCUMENTS

| | | | |
|---|---|---|---|
| 1188773 | 6/1985 | Canada | 340/628 |
| 2173770 | 10/1986 | United Kingdom | 383/71 |

*Primary Examiner*—Glen R. Swann, III

*Attorney, Agent, or Firm*—Lowell W. Gresham; Jordan M. Meschkow; Don J. Flickinger

[57] ABSTRACT

A system for disabling and protecting a particulate detector (10) as necessitated by many building, construction, and maintenance projects is disclosed. The particulate detector (10) is typically mounted on a ceiling or vertical wall surface (12), and a jacket (22) is secured to a body portion (16) of the particulate detector (10). The jacket (22) includes a non-opaque plastic container (24) with an opening (34) on one end and being substantially sealed elsewhere. A flag (26) attaches to the container (24) and hangs downward when the jacket (22) is installed on the particulate detector (10). Moreover, an opening control device (28) couples to the container (24) near the opening (34) thereof to control the size of the opening (34) so that the particulate detector (10) may be substantially inserted into the jacket (22) and so that the jacket (22) may be secured to the particulate detector (10).

11 Claims, 2 Drawing Sheets

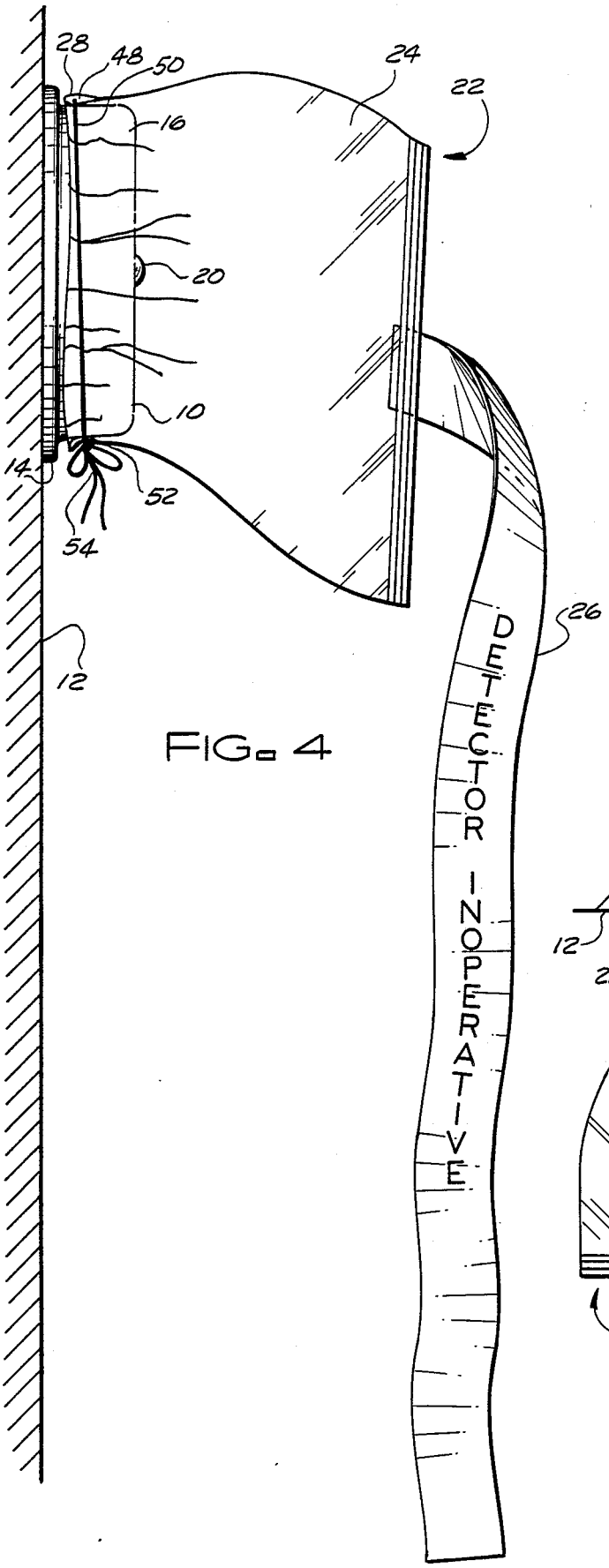
FIG. 4
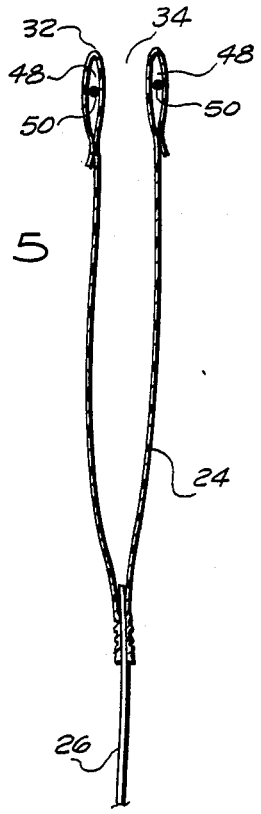
FIG. 5
FIG. 6
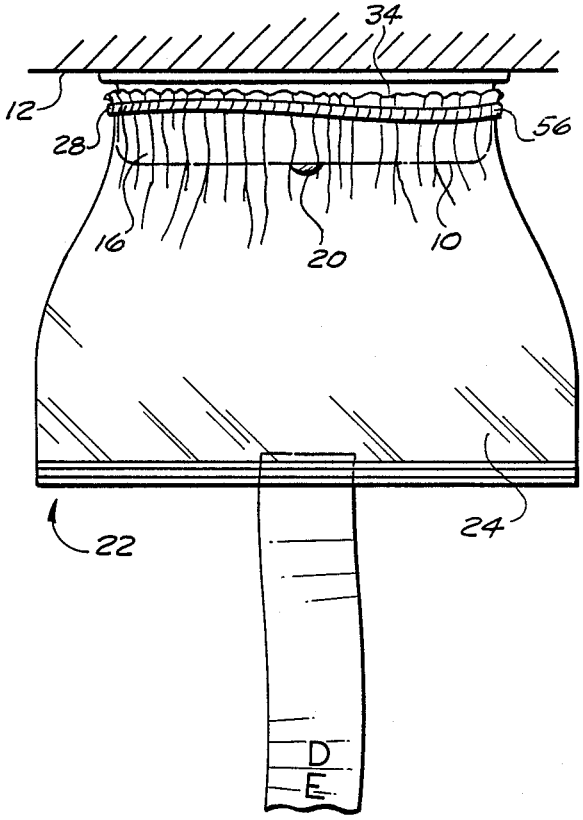

PARTICULATE DETECTOR DISABLING AND PROTECTING SYSTEM

This application is a division of application Ser. No. 07/247,522, filed Sept. 22, 1988.

TECHNICAL FIELD OF THE INVENTION

The present invention relates generally to building construction and building maintenance aids. More specifically, the present invention relates to construction and maintenance aids which prevent smoke detectors from falsely going into an alarm state during a construction or maintenance project.

BACKGROUND OF THE INVENTION

Particulate detectors, generally referred to as smoke detectors, sense particulate matter in an environment and enter an alarm state when particulates exceed a predetermined threshold. The purpose for such detectors is typically to detect smoke and provide an early warning of conditions indicative of a fire. However, such detectors typically do not discriminate between smoke and other types of particulates which may be present in an environment, such as dust, steam, or paint particles. During construction and certain maintenance projects, project environments often experience sufficient quantities of non-smoke particulates to exceed the thresholds of such particulate detectors, causing numerous annoying false alarms. Moreover, even ignoring the annoying aspects of false alarms, the levels of certain particulates, such as paint or dust, may reach such proportions that sensing chambers become coated, clogged, or otherwise contaminated and thresholds become altered, thereby reducing future effectiveness of such particulate detectors. Consequently, it is a common practice in the industry to take steps to avoid these problems.

One common technique for addressing such problems is the de-energizing of affected particulate detectors during a maintenance or construction project so that such particulate detectors cannot enter their alarm state. However, this conventional technique suffers undesirable drawbacks because it often requires the time and expense of having skilled personnel insure proper reconnection of disabled particulate detectors. Moreover, if a particulate detector is not removed from the project vicinity, the unit may still become contaminated by excessive dust or paint particles.

Another technique simply disables an entire alarm system. However, particulate detectors may still become contaminated if not removed or otherwise protected. In addition, this technique unnecessarily worsens safety hazards by disabling useful detection devices in environments remote from the project vicinity.

Yet another known technique covers particulate detectors in a project area using a wide variety of covering materials with an aim toward preventing such particulate detectors from sensing the environment. The known covering techniques have not proven satisfactory. For example, such materials are often of a makeshift nature, which does not lend itself to effectively and reliably covering a particulate detector. Moreover, such materials are often opaque so that workers cannot observe lights on specific particulate detectors to determine if such particulate detectors are in their alarm state. Still further, the known covering techniques often utilize a tape, such as conventional duct tape, to secure a covering to a particulate detector. Alternatively, in some situations, tape alone has been used to substantially enclose a particulate detector. Such taping is most undesirable because it often causes damage to a particulate detector and a particulate detector's base as a consequence of removing the tape.

Still other problems confront someone who might wish to utilize any of the above-mentioned techniques. For example, the above-mentioned techniques generally provide no indication of the fact that a particulate detector may be disabled. Consequently, those performing construction or maintenance projects can easily forget to enable such disabled particulate detectors, causing a serious life-safety hazard to tenants of a building. This problem is exaggerated when the project vicinity, including particulate detectors or any coverings attached thereto, is painted because walls, particulate detectors and coverings thereon become a single homogeneous color.

Similarly, such techniques often require time consuming and painstaking procedures to put a disabled particulate detector back into service. Thus, personnel performing long-term construction or maintenance projects are encouraged to simply leave such particulate detectors continuously disabled throughout the duration of a project. Such action poses serious life-safety hazards to occupants of a building during nights, holidays, weekends, and other periods when the project vicinity is unoccupied. Moreover, it is noted that such hazards are greater than normal because fires are more likely to occur at a construction site than at other building locations.

Accordingly, a need exists for a device and method that addresses the above-mentioned problems without suffering the substantial drawbacks associated with conventional techniques.

SUMMARY OF THE INVENTION

Accordingly, it is an advantage of the present invention that a covering for a particulate detector is provided which reliably disables the particulate detector so that false alarms do not occur and prevents contamination so that future effectiveness of the particulate detector is maintained.

Another advantage of the present invention is that the covering provided by the present invention is easily attached to and removed from a particulate detector to encourage enablement of the particulate detector at any time a project area is unoccupied.

The above and other advantages of the present invention are carried out in one form by a jacket device which, when installed on a particulate detector, prevents the particulate detector from entering its alarm state. The jacket includes a flexible container which has an opening. The container is constructed from a material which is substantially impervious to the types of particulate matter detected by the particulate detector. The container opening may exhibit an expanded state or a contracted state. Moreover, when the opening exhibits its expanded state, the opening is sufficiently large so that the particulate detector may pass through the opening. In addition, the jacket includes a device attached to the container near the container opening for causing the opening to enter its contracted state. After inserting the particulate detector into the opening, the contracted state of the opening causes the container to contact the particulate detector and become sufficiently secured to the particulate detector so that the entire weight of the jacket may be supported merely by clamping action at the contact with the particulate detector.

BRIEF DESCRIPTION OF THE DRAWINGS

A more complete understanding of the present invention may be derived by referring to the detailed description and claims when considered in connection with the FIGURES, wherein like reference numbers refer to similar items throughout the FIGURES, and;

FIG. 4 shows a second embodiment of the present invention installed relative to a particulate detector;

FIG. 5 shows a cross-sectional side view of a container portion of the second embodiment of the present invention; and FIG. 6 shows a third embodiment of the present invention installed relative to a particulate detector.

DETAILED DESCRIPTION OF THE PREFERRED EMBODIMENTS

Figure 1:
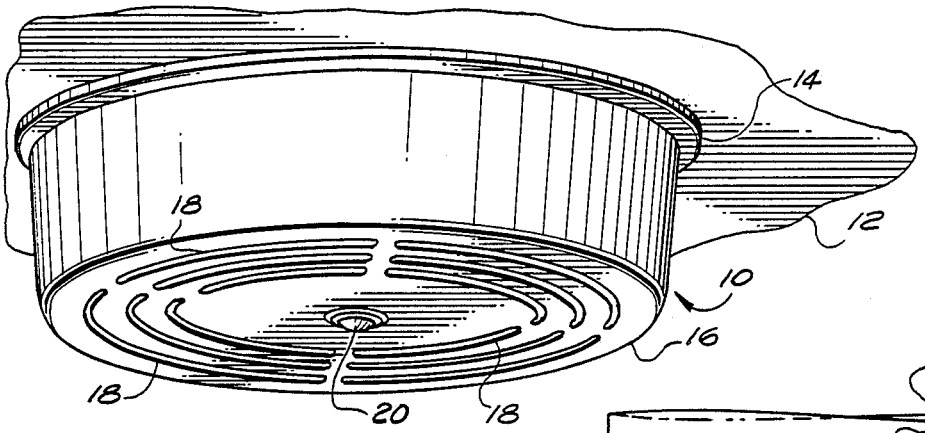
FIG. 1 shows a particulate detector used in connection with the present invention.

FIG. 1 shows a conventional particulate detector 10. Particulate detector 10 may exhibit any of a wide variety of shapes and sizes. However, particulate detector 10 is typically a cylindrical shape of approximately 6 to 10 inches in diameter and 1 to 3 inches in height. Particulate detector 10 is typically placed in service when attached to a surface 12, which represents either a vertical wall or a ceiling in FIG. 1. When particulate detector 10 is mounted on a vertical wall 12, it is typically mounted near a ceiling. Particulate detector 10 is characterized as having a base portion 14 and a housing or body portion 16. Base portion 14 is mounted on surface 12 and body portion 16 extends into a room or other environment in which particulate detector 10 is mounted. In other words, body portion 16 is exposed while base portion 14 contacts surface 12.

Body portion 16 has a plurality of holes, slots or openings 18 therein to permit substantially unrestricted movement of atmosphere through housing or body portion 16. As known to those skilled in the art, particulate detector 10 typically contains a sensing chamber (not shown) and electronic circuitry (not shown) which together allow particulate detector 10 to sense the presence of smoke, dust, steam, paint particles, or other forms of particulate matter. When the quantity of such particulate matter exceeds a predetermined threshhold, particulate detector 10 enters an alarm state. In this alarm state particulate detector 10 may continuously energize a light 20, may sound an audible alarm, or may send signals to a central control unit (not shown), which may electrically couple to particulate detector 10.

Light 20 located on body portion 16 of particulate detector 10 typically indicates the operational status of particulate detector 10. For example, light 20 may flash occasionally to indicate that particulate detector 10 is operative but not in its alarm state. As discussed above, light 20 may remain continuously lit to indicate that particulate detector 10 is in the alarm state. When light 20 does not flash or remain continuously energized, then light 20 indicates that particulate detector 10 is disabled, or otherwise not sensing the environment in which it is mounted.

Figure 2:
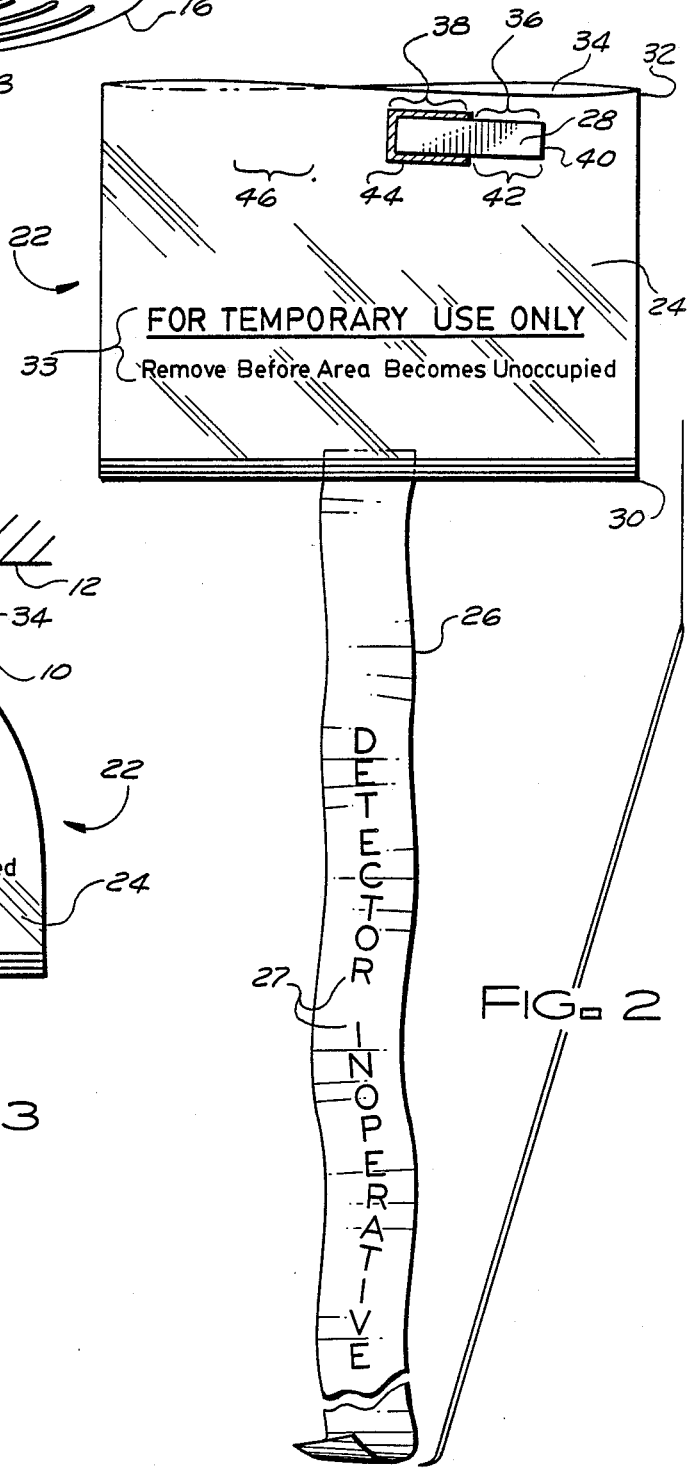
FIG. 2 shows a first embodiment of a jacket portion of the present invention.

FIG. 2 shows a first embodiment of a jacket 22 which is used in connection with the present invention. Jacket 22 includes a flexible container or bag 24, a flag 26, and an opening control device 28. In the preferred embodiment, container 24 represents a preferably transparent, or at least translucent, plastic material which forms a continuous cylindrical-shaped sheet. Container 24 is sealed at a sealed end 30 but remains open at an opening end 32. In the preferred embodiment, the plastic material from which container 24 is constructed is in the range of 1 to 3 mils thick, and the sealing which occurs at sealed end 30 is sufficient to make container 24 substantially airtight, except for an opening 34 which is provided at opening end 32 of container 24. Moreover, in the preferred embodiment the sealing which is accomplished at sealed end 30 of container 24 is performed using conventional thermal techniques.

Flag 26 attaches to container 24 at an exterior surface thereof near sealed end 30. In the preferred embodiment, flag 26 represents a ribbon-like strip of material which is greater than 12 inches, and preferably 24 to 36 inches, in length, with only one end thereof attached to container 24. The techniques used in attaching flag 26 to container 24 are not critical in the present invention. Flag 26 may, for example, be attached to container 24 using the same thermal sealing step which seals sealed end 30 of container 24. In the preferred embodiment, flag 26 is formed from a material which exhibits a bright non-white color, such as red, yellow, yellow and black, orange, or lime green so that it is easily observable. Moreover, in the preferred embodiment flag 26 includes printed indication 27 of the fact that particulate detector 10 (see FIG. 1) to which jacket 22 may be installed is in an inoperative condition. As shown in FIG. 2, the words "DETECTOR INOPERATIVE" form printed indication 27 in the preferred embodiment. However, other words or symbols could be formed on Flag 26 to achieve the same purpose.

Opening 34 of container 24 exhibits two states. An expanded state for opening 34 is depicted in FIG. 2. In this expanded state, opening 34 is sufficiently large for body portion 16 of particulate detector 10 (see FIG. 1) to pass through opening 34. On the other hand, when opening 34 is in a contracted state, opening 34 is significantly smaller than it is in its expanded state. An opening control device 28 serves to control the state of opening 34 at any given time. FIG. 2 depicts a first embodiment of the present invention in which opening control device 28 represents a strip 35 having first and second adjacent portions 36 and 38, respectively. Strip 35 in this first embodiment is located near opening end 32 of container 24, and preferably within 1 to 2 inches of opening end 32. Both of portions 36 and 38 contain an adhesive 40 on a common side of strip 35. Adhesive 40 permits strip 35 to stick to the material from which container 24 is made. As shown in FIG. 2, first portion 36 is attached by adhesive 40 to a location 42 on container 24. However, second portion 38 is temporarily attached to a tab 44 and not to container 24 when opening 34 is in the expanded state. In the preferred embodiment, tab 44 represents a sufficiently slick material so that tab 44 may be removed from strip 35 without harming the adhesive properties of adhesive 40 residing on second portion 38 thereof. Moreover, in the preferred embodiment tab 44 is slightly larger than strip 35 in at least one dimension thereof so that tab 44 may be easily separated from strip 35.

Figure 3:
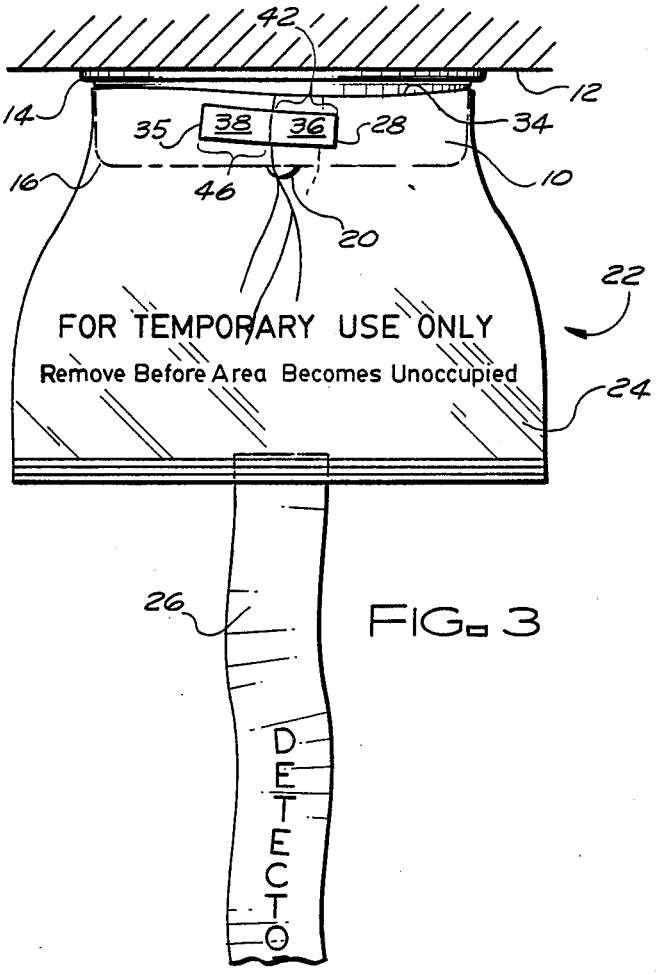
FIG. 3 shows the first embodiment of the jacket portion of the present invention installed relative to a particulate detector.

This first embodiment of jacket 22 may be secured to a particulate detector 10 by gathering together portions of the flexible material from which container 24 is made so that a second location 46 of container 24, which is not adjacent to first location 42 when opening 34 is in its expanded state (see FIG. 2), resides near location 42, and attaching second portion 38 of strip 35 to container 24 at location 46, as shown in FIG. 3. Of course, tab 44 must first be removed from strip 35 before strip 35 can attach to location 46 on container 24. This attaching action constricts opening 34 so that opening 34 exhibits its contracted state and causes container 24 to tightly grip particulate detector 10. As depicted in FIG. 3, surface 12, to which particulate detector 10 is attached, represents a ceiling. The gripping of container 24 against body portion 16 of particulate detector 10 is sufficiently tight so that the entire weight of jacket 22, including container 24, flag 26, and opening control device 28, is fully supported by this frictional clamping action against particulate detector 10.

Consequently, jacket 22 becomes secured to particulate detector 10 by a clamping action. The use of a clamping action permits easy installation and removal of jacket 22. This easy installation and removal feature encourages removal of jacket 22 when a project area is to be unoccupied, thereby promoting safety. Moreover, smoke, dust, paint particles, steam, or other particulate matter cannot significantly penetrate container 24 to cause particulate detector 10 to enter its alarm state, and particulate detector 10 is protected from contamination by excessive amounts of such particulates. Since a transparent, or at least translucent, material is utilized in the construction of container 24, light 20 may be observed from the exterior of container 24. Thus, a person can observe light 20 on particulate detector 10 through container 24 to determine if particulate detector 10 is in its alarm state. In addition, flag 26 of jacket 22 extends downward from surface 12 into a room or other environment in which particulate detector 10 is mounted. Since flag 26 is a relatively bright, non-white color, it is easily observed, and provides a warning-type indication of the fact that particulate detector 10 is inoperative when jacket 22 is secured thereto. Even when jacket 22 is utilized in connection with a painting project, flag 26 hangs a sufficient distance away from surface 12 so that it need not become completely covered with paint and thus would provide the necessary readily observable qualities.

FIGS. 4 and 5 show a second embodiment of the present invention. In FIG. 4, surface 12 represents a vertical wall on which particulate detector 10 is mounted. Consequently, as shown in FIG. 4, when jacket 22 is secured to particulate detector 10, flag 26 thereof hangs downward, or relatively parallel to surface 12. The material from which container 24 is constructed is sufficiently rigid so that when jacket 22 is secured to particulate detector 10 flag 26 is spaced away from surface 12. Thus, during painting projects, flag 26 need not interfere with the painting of surface 12 and need not be painted itself.

In this second embodiment of the present invention, container 24 is turned back on itself at opening end 32 and attached to itself at the exterior of container 24 so that a pocket 48 is formed. Pocket 48 entirely surrounds opening 34 except for a small pocket opening 52 in pocket 48. A drawstring 50 resides within pocket 48 and exits pocket 48 at pocket opening 52. Drawstring 50 and pocket 48 are shown in more detail in the cross-sectional side view presented in FIG. 5. Container 24 may be attached to itself using any convenient technique, such as an adhesive, a thermal technique, or by sewing. Drawstring 50 does not attach to container 24 within pocket 48. Consequently, drawstring 50 is free to slide within pocket 48 relative to container 24. Thus, opening 34 exhibits its expanded state when drawstring 50 is untied and a maximum amount of drawstring 50 resides within pocket 48. On the other hand, opening 34 exhibits its contracted state by pulling drawstring 50 relative to pocket 48, or extracting a portion of drawstring 50 from pocket 48, so that less of drawstring 50 resides within pocket 48. After opening 34 has been sufficiently constricted to clamp jacket 22 to particulate detector 10, the tying of a knot 54 in drawstring 50 forces opening 34 to remain in its contracted state. Thus, by placing container 24, when opening 34 is in its expanded state, over particulate detector 10, pulling drawstring 50, and tying knot 54 in drawstring 50, jacket 22 becomes secured to particulate detector 10 through a frictional coupling which clamps container 24 between drawstring 50 and body portion 16 of particulate detector 10.

FIG. 6 shows a third embodiment of the present invention. FIG. 6 depicts particulate detector 10 as being mounted to a surface 12 which represents a ceiling. In FIG. 6, opening control device 28 represents an elastic band 56 which couples to container 24 near opening 34 and substantially surrounds opening 34. The expanded state of opening 34 of container 24 occurs when elastic band 56 is expanded to approximately the full extent permitted by the quantity of material surrounding opening 34 or as necessary to accommodate particulate detector 10. In this expanded state, body portion 16 of particulate detector 10 is inserted through opening 34 into the interior of container 24. Opening 34 is then constricted so that it exhibits its contracted state by simply withdrawing any force applied to elastic band 56 surrounding opening 34 and allowing elastic band 56 to contract until it clamps against body portion 16 of particulate detector 10. This clamping action provides sufficient frictional force so that the entire weight of jacket 22 may be supported by particulate detector 10.

In summary, the present invention provides jacket 22 which substantially covers particulate detector 10 so that particulate detector 10 may be reliably disabled during a building, construction or building maintenance project and so that particulate detector 10 may be protected from potential contamination. In addition, the three separate embodiments discussed above are each easily attached to and removed from particulate detector 10. Consequently, jackets 22 as described herein may realistically be removed and installed often during a long-term construction project so that particulate detector 10 may be placed in service during nights, holidays, weekends, or other extended periods of time when no person may be in the vicinity. Further, the transparency of container 24 allows light 20 of particulate detector 10 to be observed when jacket 22 is secured to particulate detector 10. Additionally, flag 26 forms an easily observed warning-type indicator of the fact that jacket 22 is installed on particulate detector 10 and that particulate detector 10 is inoperative.

The foregoing description uses preferred embodiments to describe the present invention. However, those skilled in the art will recognize that many changes and modifications to these preferred embodiments may occur without exceeding the scope of the present invention. For example, the specific dimensions mentioned herein are not critical to the scope of the present invention but are presented herein merely to aid in providing an understanding of it. Moreover, the operational characteristics of light 20 of particulate detector 10 are not critical to the present invention. Obvious changes and modifications to these and other characteristics of the embodiments described above are intended to be included within the scope of the present invention.

I claim:

1. A method of disabling an otherwise operational particulate detector, said method comprising the steps of:

inserting said particulate detector into a flexible bag having an opening therein, said opening having an expanded state and a contracted state, said opening being sufficiently large in said expanded state for said particulate detector to pass through said opening, and said bag being constructed from a material which is substantially impervious to dust; and constricting said bag opening so that said opening exhibits said contracted state, said bag contacts said particulate detector, and said bag becomes sufficiently secured to said particulate detector so that the entire weight of said bag is supportable by said contact with said particulate detector.

2. A method as claimed in claim 1 additionally comprising the step of forming said bag from a non-opaque material so that said particulate detector is observable from outside said bag after said constricting step.

3. A method as claimed in claim 2 additionally comprising the step of attaching a flag to said bag, said flag being attached so that it extends downward from said bag after said constricting step.

4. A method as claimed in claim 1 wherein said constricting step comprises the steps of:

gathering portions of said bag together proximate said opening; and applying a tape having first and second adjacent adhesive portions, said first portion being affixed to said bag at a first location thereon proximate said opening and said second tape portion being affixed to said bag at a second location proximate said opening thereon, said second location not residing adjacent to said first location.

5. A method as claimed in claim 1 wherein said constricting step comprises the step of pulling a drawstring slidably coupled to said bag proximate to and substantially surrounding said opening.

6. A method as claimed in claim 1 additionally comprising the step of attaching a flag to said bag, said flag being attached so that it extends downward beneath said bag after said constricting step to draw attention to the presence of said jacket.

7. A method for operating a particulate detector in a substantially disabled state, said particulate detector exhibiting an alarm state when said particulate detector detects a quantity of particulate matter which is in excess of a predetermined threshold, and said method comprising the steps of:

partially inserting said particulate detector into a flexible container having an opening therein, said opening being sufficiently large for said particulate detector to pass through said opening, and said container being constructed from a material which is substantially impervious to said particulate matter;

clamping a portion of said container proximate said opening to said particulate detector to attach said container to said particulate detector so that the entire weight of said container is supported by said clamping; and dangling a strip of material beneath said container to draw attention to the presence of said container.

8. A method as claimed in claim 7 additionally comprising the step of observing said particulate detector through said container to determine whether said particulate detector is in said alarm state.

9. A method as claimed in claim 7 wherein said dangling step extends said strip of material a distance of at least 12 inches beneath said container.

10. A method as claimed in claim 7 wherein said dangling step comprises the step of displaying a non-white color from said strip of material to enhance the attention drawing ability of said strip of material.

11. A method as claimed in claim 7 wherein particulate detector mounts on a generally vertical surface, and said dangling step comprises the step of spacing said strip of material away from said surface to reduce interference from said strip of material with activities conducted in connection with said surface.

* * * * *